313-414 SR
6/17/86 OR 4,595,858

United States Patent [19]

Hale

[11] Patent Number: 4,595,858

[45] Date of Patent: Jun. 17, 1986

[54] REINFORCING MEANS FOR A CUP-SHAPED ELECTRON GUN ELECTRODE

[75] Inventor: John R. Hale, East Hempfield Township, Lancaster County, Pa.

[73] Assignee: RCA Corporation, Princeton, N.J.

[21] Appl. No.: 677,529

[22] Filed: Dec. 3, 1984

[51] Int. Cl.[4] ..... H01J 29/58; H01J 29/82

[52] U.S. Cl. ..... 313/414; 313/409; 313/411; 313/417; 313/456

[58] Field of Search ..... 313/409, 411, 414, 417, 313/456, 458, 407, 402

[56] References Cited

U.S. PATENT DOCUMENTS

| | | | |
|---|---|---|---|
| 2,810,851 | 10/1957 | Johnson | 313/456 |
| 2,888,588 | 5/1959 | Dichter | 313/458 |
| 2,922,062 | 1/1960 | Mayer et al. | 313/82 |
| 3,319,102 | 5/1967 | Johnson | 313/45 |
| 3,722,043 | 3/1973 | Kirchner | 313/402 |
| 3,855,493 | 12/1974 | Snook et al. | 313/402 |
| 4,049,990 | 9/1977 | Collins | 313/417 |
| 4,049,991 | 9/1977 | Collins | 313/417 |
| 4,061,941 | 12/1977 | Hallett et al. | 313/414 |
| 4,298,818 | 11/1981 | McCandless | 313/417 |
| 4,370,592 | 1/1983 | Hughes et al. | 313/414 |
| 4,437,036 | 3/1984 | Ragland, Jr. | 313/402 |
| 4,461,971 | 7/1984 | Puhak | 313/402 |
| 4,484,102 | 11/1984 | Hale | 313/417 |

*Primary Examiner*—David K. Moore
*Assistant Examiner*—M. Razavi
*Attorney, Agent, or Firm*—Eugene M. Whitacre; Dennis H. Irlbeck; Vincent J. Coughlin, Jr.

[57] ABSTRACT

An electron gun assembly includes a plurality of cathode assemblies and a plurality of spaced successive electrodes mounted on at least two electrically-insulative support rods. At least one of the electrodes comprises a deep-drawn substantially rectangular cup-shaped member having a base portion, a supporting flange portion, including a plurality of attachment tabs, and a sidewall extending therebetween. The sidewall includes a plurality of reinforcing ribs formed therein which extend substantially from the supporting flange portion to the opposite end of the sidewall adjacent to the base. The reinforcing ribs minimize the flexure of the sidewall.

5 Claims, 6 Drawing Figures

REINFORCING MEANS FOR A CUP-SHAPED ELECTRON GUN ELECTRODE

BACKGROUND OF THE INVENTION

The present invention relates to an inline electron gun for a plural beam cathode-ray tube and, more particularly, to a structure for reinforcing an electrode member for such a gun assembly.

The electrode members of an inline electron gun assembly are serially arranged to accelerate and focus a plurality of electron beams along spaced, co-planar electron beam paths. The electrode members of the gun assembly are mechanically secured by means of attachment tabs and studs to at least a pair of insulative support rods which extend along the beam paths. Each of the electrode members commonly has several spatially-related apertures formed therein to accommodate the respective electron beams generated within the electron gun assembly. It is important that these several apertures be accurately located and aligned relative to the related apertures in adjacent electrode members, and to the respective electron generating surfaces. During the fabrication of the electron gun assembly, the attachment tabs and studs of the various electrode members are embedded into the temporarily heat-softened insulative support rods; at which time the support rods on opposed sides of the gun assembly are pressured inwardly toward the electrode members to force the attachment tabs and studs into the support rods. The compressive pressure tends to exert a distorting force upon the several deep drawn, cup-shaped electrode members which comprise the main focus lens of the electron gun assembly.

Most experience to date with conventional deep drawn, cup-shaped electrodes, having sidewalls up to about 12.7 mm long, shows that these electrodes tend to develop a negative or concave "oil-canning" tendency, i.e., the sidewall of the electrode tends to bow inwardly toward the electron beam axes. When studs are welded to opposite sides of the sidewall of such electrodes, exact positioning and welding is difficult because of the variable slope and degree of negative "oil-canning" that occurs.

An even greater problem has been encountered in electron guns in which ultra-deep drawn, cup-shaped electrodes have sidewalls about 19.05 mm long. In such ultra-deep drawn electrodes, a critical thinning of the sidewall occurs. The apex of the "oil-canning" in these electrodes occurs about 10.16 mm from the support flange located at the open end of the electrode. In the vicinity of the apex, the sidewall thins from the desired thickness of about 0.25 mm to about 0.19 mm. If the "oil-canning" is negative or concave on both sides of the sidewall, the problem of stud positioning is similar to that of the shorter deep drawn electrodes described above; however, if the "oil-canning" of one side of the sidewall is positive or convex and the other side is negative or concave, or if both sides exhibit positive or convex "oil-canning", a new phenomenon occurs. During the beading operation in which the insulative support rods are heated to a molten state and formed into contact with the attachment tabs and studs of the electron gun, the positive or convex "oil-canning" sidewall is forced inward by the stud attached to the sidewall of the previously convex surface.

The inward displacement of the previously convex sidewall acts like a loaded spring. As soon as the arms of the beading apparatus retract at the end of the beading cycle, the compressed sidewall of the electrode tends to return to its previous convex position forcing the insulative support rods, which are still in a plastic state, to bulge outwardly. Shear forces are thereby introduced into the insulative support rods during the cooling-deflection cycle causing the support rods to crack in the vicinity of the attachment tabs or studs.

Even in electron guns in which the stress forces are not sufficiently great to crack the support rods, the varying degree of "oil-canning" of the sidewalls can cause a side-to-side displacement or offset of the ultra-deep drawn electrode relative to the other electrode members of the main focus lens resulting in a change of aperture locations relative to those in the adjacent electrode members, thereby producing deleterious inter-electrode spacing relationships and distortion in the electron beam trajectories.

U.S. Pat. No. 4,484,102, issued to J. R. Hale on Nov. 20, 1984, discloses a structure for strengthening the sidewall of a conventional deep drawn electrode. The Hale patent is incorporated by reference herein for the purpose of disclosure. The structure described therein comprises a wedge-shaped shoulder that is formed in opposite parallel sides of the sidewall of a deep drawn substantially rectangular cup-shaped member. The wedge-shaped shoulder projects outwardly at an acute angle of about 45 degrees from the sidewall and extends into the supporting flange of the electrode adjacent to the attachment tabs. This structure is insufficient to prevent flexure of the sidewall of ultra-deep drawn electrodes.

A structure for ruggedizing planar electrode members, which are commonly used as the control and screen grid electrodes of an electron gun assembly, is disclosed in U.S. Pat. No. 4,049,990 and in U.S. Pat. No. 4,049,991. Both patents were issued to F. K. Collins on Sept. 20, 1977. In the Collins' patents, intersecting rib-like embossments are formed along the surface of the planar electrodes with at least one of the ribs extending into the attachment tabs. Such a structure strengthens the supporting surface or flange portion of a planar electrode. However, the patents do not suggest strengthening of the sidewall of deep-drawn substantially cup-shaped electrode members, such as the focusing electrodes of the electron gun assembly.

SUMMARY OF THE INVENTION

An electron gun assembly includes means for generating and focusing a plurality of electron beams. The focusing means includes at least one substantially cup-shaped member having a first end, an oppositely disposed second end and a sidewall extending therebetween. The sidewall includes reinforcing means formed therein and extending substantially from the first end to the second end to minimize the flexure of the sidewall.

DETAILED DESCRIPTION OF THE PREFERRED EMBODIMENT

Figure 1:
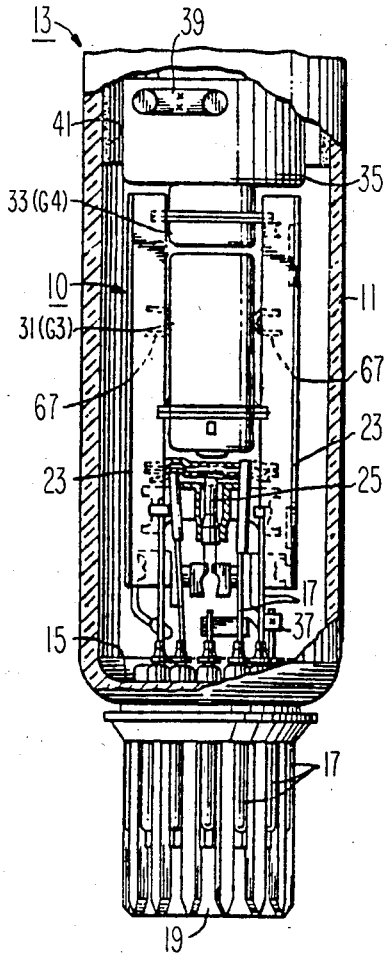
FIG. 1 is a partially broken-away side elevational view of an electron gun assembly incorporating a novel cup-shaped electrode having reinforcing means.
Figure 2:
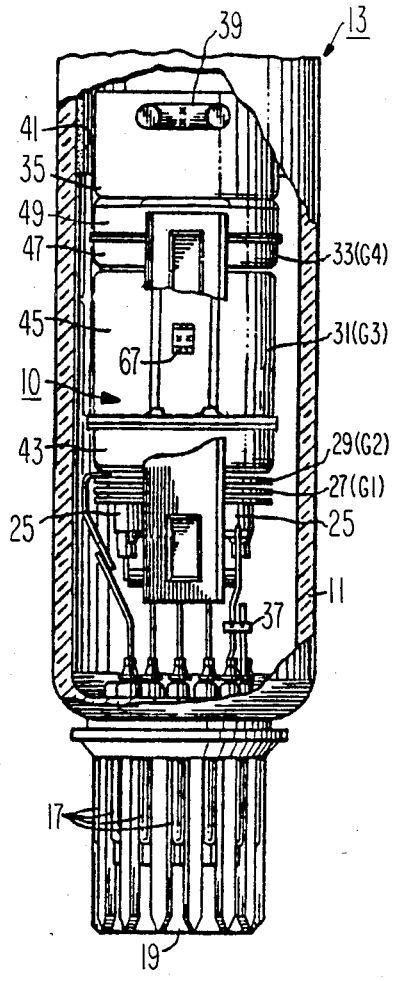
FIG. 2 is a partially broken-away front elevational view of the electron gun having the novel electrode of FIG. 1.

FIGS. 1 and 2 show structural details of an improved inline electron gun assembly 10 centrally mounted in the neck 11 of a cathode-ray tube, CRT 13. The CRT 13 includes an evacuated envelope (not shown) closed at the neck end by a glass stem 15 having a plurality of leads or pins 17 extending therethrough. A base 19 is attached to the pins 17 outside the envelope. A faceplate (not shown), having a viewing screen, closes the other end of the envelope. A funnel (not shown) extends between the faceplate and the neck 11 of the envelope.

The inline electron gun assembly 10 is designed to generate and focus three electron beams along spaced, co-planar convergent beam paths having a common, generally longitudinal direction toward the viewing screen. The gun assembly 10 comprises two insulative support means 23 which are preferably glass support rods from which the various components are supported to form a coherent unit in a manner commonly used in the art. These components include three substantially equally transversely-spaced, co-planar cathodes 25 (one for producing each beam), a control-grid electrode 27 (also referred to as G1), a screen-grid electrode 29 (also referred to as G2), a first focusing electrode 31 (also referred to as G3), a second focusing electrode 33 (also referred to as G4), and a shield cup 35, longitudinally-spaced in that order along the support rods 23. The electrodes 31 and 33 form the main focus lens of the electron gun assembly 10. The various electrodes of the gun assembly 10 are electrically connected to the pins 17, either directly or through metal ribbons 37. The gun assembly 10 is held in a predetermined position in the neck 11 on the pins 17 and with snubbers 39 on the shield cup 35 which press on and make contact with an electrically conducting internal coating 41 on the inside surface of the neck 11. The internal coating 41 extends over the inside surface of the funnel and connects to the anode button (not shown). A conventional getter assembly (not shown) is attached at one end to the cup 35 and extends in cantilever fashion in the funnel of the envelope.

Figure 3:
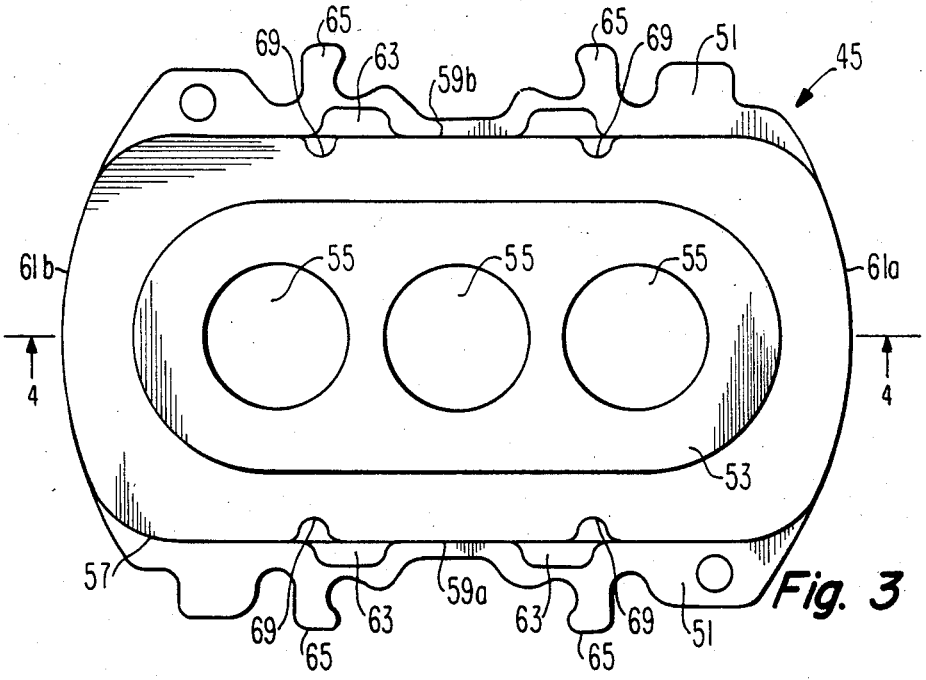
FIG. 3 is a plan view of one embodiment of the novel electrode of FIG. 1.
Figure 4:
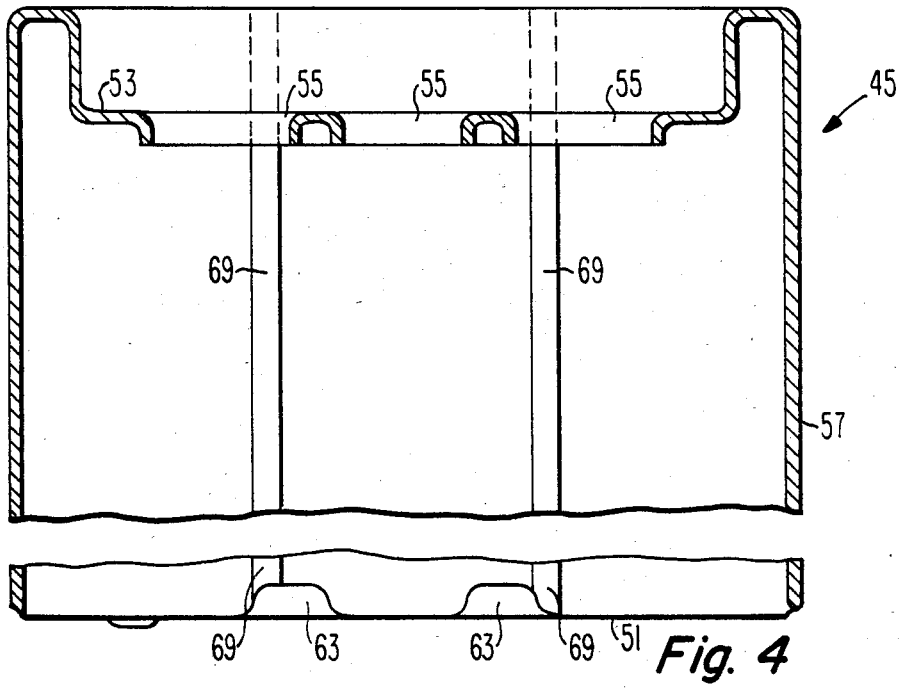
FIG. 4 is a sectional view taken along line 4—4 of FIG. 3.

The first focusing electrode 31 comprises first and second substantially rectangular cup-shaped members 43 and 45, respectively, while the second focusing electrode 33 comprises first and second substantially rectangular cup-shaped members 47 and 49, respectively. The cup-shaped members are joined together at their open ends. One of the cup-shaped members 45 is shown in FIGS. 3 and 4. The cup-shaped member 45 is an ultra-deep drawn part comprising a supporting flange portion 51 located at the open end and a base portion 53 located adjacent to the opposite end. The base portion 53 is substantially parallel to the supporting flange portion 51. Three inline beam-defining apertures 55 are formed through the base portion 53. A sidewall 57, having substantially parallel opposed sides **59*a* and 59*b* and opposed end portions 61*a* and 61*b*, extends between the supporting flange portion 51 and the base portion 53 of the cup-shaped member 45. As described in U.S. Pat. No. 4,484,102, referenced herein, at least one protuberance 63 projects outwardly at an acute angle from each of the opposed sides 59*a* and 59*b* of the sidewall 57 and extends into the supporting flange portion 51. A plurality of attachment tabs 65 are formed in the supporting flange portion 51 adjacent to each of the opposed sides 59*a* and 59*b* of the sidewall 57 to facilitate attaching the cup-shaped member 45 to the glass support rods 23. As shown in FIGS. 1 and 2, a pair of studs 67 are attached to the sidewall 57, one stud to each of the opposed sides 59*a* and 59*b*. The studs 67 and the attachment tabs are embedded into the support rods 23. The sidewall 57 of the cup-shaped member 45 has an overall length of about 19.05 mm and a nominal thickness of 0.25 mm. As discussed herein, in ultra-deep drawn electrodes such as cup-shaped member 45, there is a tendency for thinning to occur in the sidewall 57. The thinned sidewall 57 will "oil-can", i.e., bow either inwardly or outwardly, unless the sidewall is strengthened. It is impractical to increase the sidewall thickness by increasing the thickness of the metal used to fabricate the cup-shaped member since this causes manufacturing difficulties. Accordingly, applicant has devised a way of increasing the rigidity of the sidewall 57 without introducing other problems. As shown in FIGS. 3–4, reinforcing means, e.g., a plurality of reinforcing ribs 69, are formed in the oppositely disposed sides 59*a* and 59*b* of the sidewall 57 to minimize the flexure thereof. The reinforcing ribs 69 extend substantially longitudinally from the protuberances 63 which extend into the supporting flange portion 51 to the opposite end of the sidewall 57 adjacent to the base portion 53. The reinforcing ribs 69** are directed inwardly toward the oppositely disposed rib on the opposite sidewall.

Figure 5:
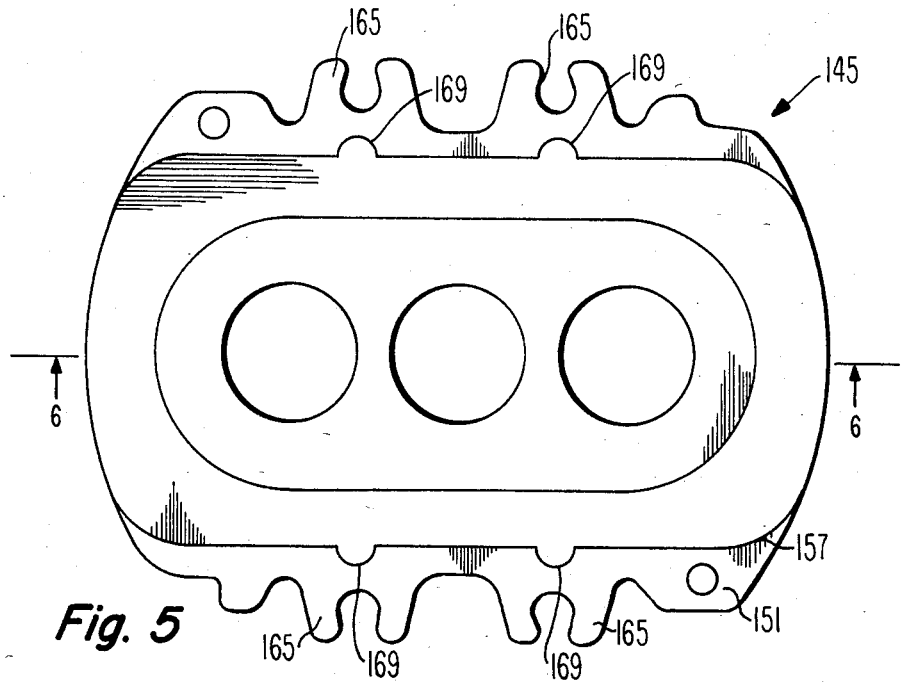
FIG. 5 is a plan view of a second embodiment of the novel electrode of FIG. 1.
Figure 6:
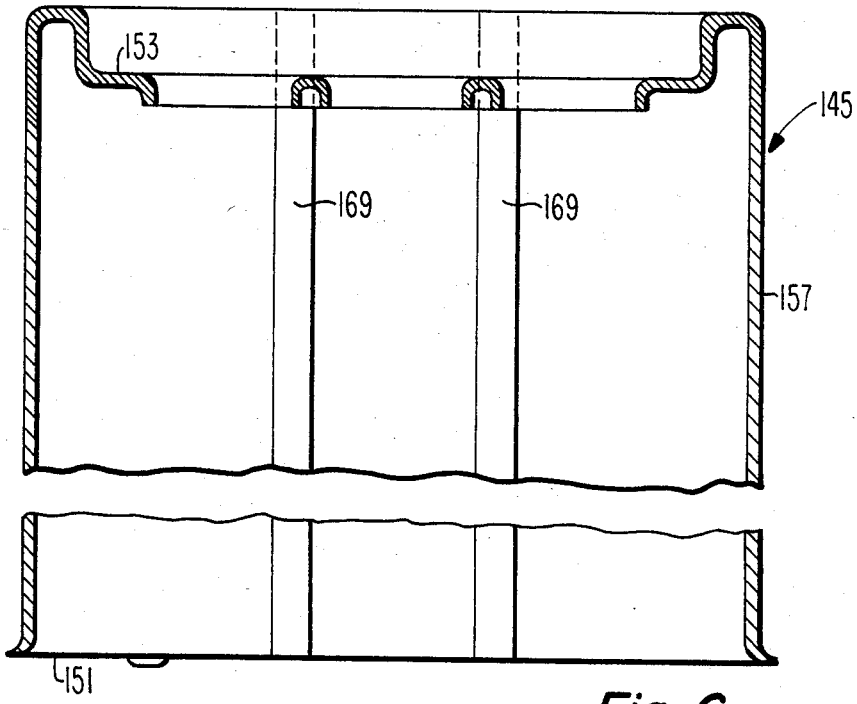
FIG. 6 is a sectional view taken along line 6—6 of FIG. 5.

A second embodiment of the novel cup-shaped member 145 is shown in FIGS. 5 and 6. In this embodiment, the reinforcing means may comprise a plurality of reinforcing ribs 169 which are directed outwardly toward the attachment tabs 165 and which extend longitudinally along the sidewall 157 substantially from the supporting flange portion 151 to the opposite end adjacent to the base portion 153. While no protuberances are shown in FIGS. 5 and 6, it should be clear to one skilled in the art that they may be included to provide additional reinforcing of the sidewall 145 adjacent to the supporting flange portion 151.

While the reinforcing ribs 69 and 169 are described with reference to ultra-deep drawn cup-shaped members having a length of about 19.05 mm, the reinforcing ribs of the present invention may be used in cup-shaped members of shorter overall length such as cup-shaped members 43, 47 and 49. Applicant has determined that the reinforcing ribs 69 and 169 minimize the flexure of the sidewall 57 and 157 during the welding of the studs 67 thereto and when the cup-shaped members 45 and 145 are attached to the support rods 23, thereby maintaining the parallelism of the base portion to the supporting flange portion of the respective members.

What is claimed is:

1. In an electron gun assembly for use in a cathode-ray tube, said gun assembly including a beam forming region and a main focus lens for generating and directing a plurality of electron beams along spaced, co-planar beam paths, said beam forming region and said main focus lens being longitudinally spaced along a plurality of insulative support means, said main focus lens including at least one substantially cup-shaped member having a base portion adjacent to one end, a supporting flange portion substantially parallel to the base portion at the oppositely disposed other end and a sidewall extending therebetween, said supporting flange portion including attachment means to facilitate securing said member to said insulative support means, the improvement wherein said sidewall includes a plurality of reinforcing ribs formed therein and extending longitudinally substantially from said one end adjacent to said base portion to said supporting flange portion at the oppositely disposed other end to minimize flexure of said sidewall resulting from securing said member to said insulative support means thereby maintaining the parallelism of said base portion and said supporting flange portion.

2. In an inline electron gun assembly for use in a cathode-ray tube, said gun assembly including three co-planar cathodes, a control grid electrode, a screen grid electrode and at least two focus electrodes longitudinally spaced along at least two glass support rods in the order named, at least one of said focusing electrodes comprising a first and a second substantially rectangular cup-shaped member joined together at their open ends, at least one of said cup-shaped members having a supporting flange portion located at the open end and a base portion located adjacent to the opposite end, said base portion being substantially parallel to said supporting flange portion and being connected thereto by a sidewall having opposed sides and opposed end portions, said base portion having three inline apertures therethrough, said supporting flange portion including a plurality of attachment tabs projecting outwardly therefrom, said tabs being adjacent to each of said opposed sides of said sidewall, at least two studs attached to said sidewall, one stud being attached to each of said opposed sides, said studs and said attachment tabs being embedded into said glass support rods to secure said member thereto, the improvement wherein said sidewall includes a pair of reinforcing ribs formed in each of said opposed sides of said sidewall, said ribs extending longitudinally substantially from said supporting flange to the opposite end of said sidewall to minimize flexure of said opposed sides of said sidewall in the vicinity of said studs during the embeddment of said studs and said attachment tabs into said glass support rods, thereby maintaining the parallelism of said base portion and said supporting flange portion.

3. The electron gun assembly as in claim 2, wherein said sidewall includes at least one protuberance formed in each of the opposed sides thereof, said protuberance projecting outwardly at an acute angle from each of said opposed sides and extending into said supporting flange, said reinforcing ribs extending from said protuberance to the opposite end of the sidewall.

4. The electron gun assembly as in claim 2, wherein said reinforcing ribs are directly inwardly towards each other.

5. The electron gun assembly as in claim 2, wherein said reinforcing ribs are directly outwardly toward said attachment tabs.

* * * * *